US008074421B2

(12) United States Patent
Di Maria

(10) Patent No.: US 8,074,421 B2
(45) Date of Patent: Dec. 13, 2011

(54) DISPOSABLE STRUCTURE OF MESH CONSTRUCTION FOR MAKING FOUNDATIONS, PLINTHS AND CONSTRUCTION ELEMENTS IN GENERAL

(76) Inventor: Benedetto Di Maria, Melegnano (IT)

( * ) Notice: Subject to any disclaimer, the term of this patent is extended or adjusted under 35 U.S.C. 154(b) by 868 days.

(21) Appl. No.: 11/992,575

(22) PCT Filed: Aug. 4, 2006

(86) PCT No.: PCT/EP2006/007786

§ 371 (c)(1),
(2), (4) Date: Apr. 23, 2008

(87) PCT Pub. No.: WO2007/039008

PCT Pub. Date: Apr. 12, 2007

(65) Prior Publication Data

US 2009/0256054 A1 Oct. 15, 2009

(30) Foreign Application Priority Data

Sep. 30, 2005 (IT) ..... MI050340 U

(51) Int. Cl.
*E04C 5/03* (2006.01)

(52) U.S. Cl. ..... 52/649.3; 220/485

(58) Field of Classification Search ..... 52/649.1, 52/649.2, 649.3, 671, 672; 220/485, 491, 220/492, 493, 494, 668; 428/596, 597; 249/48, 50

See application file for complete search history.

(56) References Cited

U.S. PATENT DOCUMENTS

| | | | | |
|---|---|---|---|---|
| 670,827 | A * | 3/1901 | White | 52/671 |
| 6,112,489 | A | 9/2000 | Zweig | |
| 6,295,770 | B1 * | 10/2001 | Sheu et al. | 52/649.2 |
| 2003/0024202 | A1 | 2/2003 | Yamashita et al. | |

FOREIGN PATENT DOCUMENTS

EP 0 378 354 A 7/1990

* cited by examiner

*Primary Examiner* — Michael Safavi
(74) *Attorney, Agent, or Firm* — Themis Law

(57) ABSTRACT

A disposable structure for making foundations, plinths and construction elements in general wherein there is provided an iron reinforcement (12, 13) arranged in at least one containment element (14) for receiving concrete (16), wherein the at least one containment element (14) comprises a metal sheet exhibiting a series of main V-shaped ribs (19), interspaced from one another and connected by a mesh construction (20), which realizes a beehive structure, and by further secondary ribs (21), also shaped as a V, in a central zone of the mesh construction, the series of main V-shaped ribs (19) being arranged against the iron reinforcement (12, 13) and having a height (h) between 1.5 and 3.0 cm.
Such type of structure can be entirely made at the factory and installed in position at the yard.

4 Claims, 3 Drawing Sheets

DISPOSABLE STRUCTURE OF MESH CONSTRUCTION FOR MAKING FOUNDATIONS, PLINTHS AND CONSTRUCTION ELEMENTS IN GENERAL

The present invention relates to a disposable structure for making foundations, plinths and construction elements in general.

In the building field, so-called formworks containing the reinforcing rods and the casting are used to make foundations, plinths and construction elements in general through casting. Such formworks must be arranged to obtain the desired shape, suitably spaced from the reinforcement by special spacers and then, once the casting has settled therein, they must be removed.

These operations imply costs for the component materials of the formwork and costs relating to the assembly and removal of the formwork on site. In fact, once the casting to be made has been identified, it is necessary to construct the reinforcement on site usually with wooden panels, with long times of installation for the placing, besides the panels, also of props, spacers, pickets, etc. Further idle times are used to remove the various formwork components, when the casting is complete and settled. Moreover, it should not be forgotten that the panels, quite expensive, are subject to breakage, damaging and must sometimes be cut on site to adapt them to the size of the casting being made.

It should be noted that it has been tried to use elements shaped as panels, for example of galvanised sheet, which are fixed around the reinforcing rods and constrained in the casting position by arranging pebble gravel on the profile for stiffening them during the casting. Such panels must be spaced from the rods in a suitable manner as well and then remain incorporated into the casting of the desired structure.

Such type of panels, due to the arrangement of the initial pebble gravel and their structure, must be adapted to the cast products to be made, thus proving quite complicate during use.

In general, therefore, in all the known systems there is the need of making formwork and reinforcement on the site of application, with problems of alignments, incorrect positioning of the parts, and anything else required to obtain a perfect casting.

An object of the present invention is to provide a disposable structure for making foundations, plinths and construction elements which should be very easy to apply in association with the reinforcing rods, and which should have very low manufacturing and application costs.

Another object of the present invention is to provide a disposable structure of the type mentioned above which should conform to the regulations relating to the construction of reinforced concrete casting.

Yet another object of the present invention is to provide a disposable structure of the type mentioned above which should be perfectly conforming in relation to the arrangement of the portions thereof (formwork, iron reinforcement) without the need of realisation directly on site.

These objects according to the present invention are achieved by providing a disposable structure for making foundations, plinths and construction elements in general as described in claim 1.

The further claims define the additional features of the present invention.

The features and advantages of a disposable structure for making foundations, plinths and construction elements in general according to the present invention will appear more clearly from the following description, made by way of an indicative non-limiting example with reference to the annexed schematic drawings, wherein.

Figure 1:
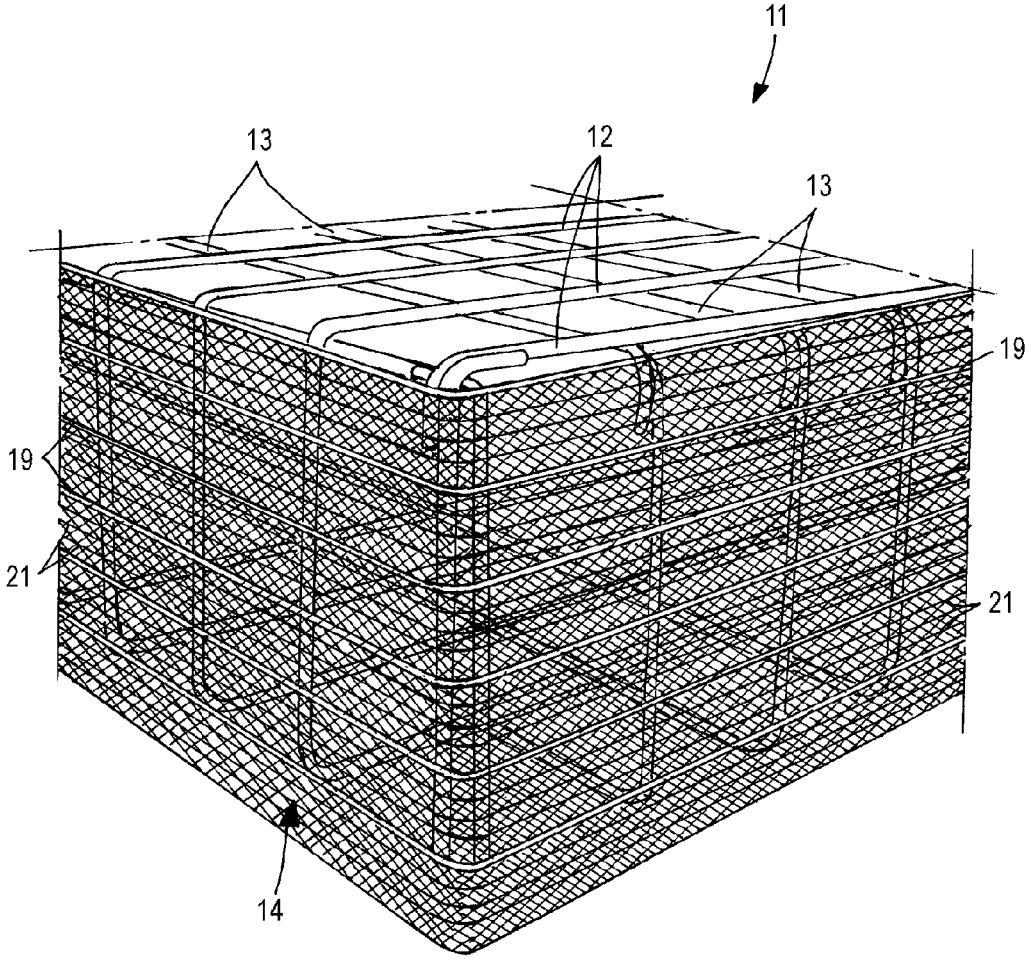
FIG. 1 shows a perspective partial view of a disposable structure for making a plinth before the concrete is cast.
Figure 2:
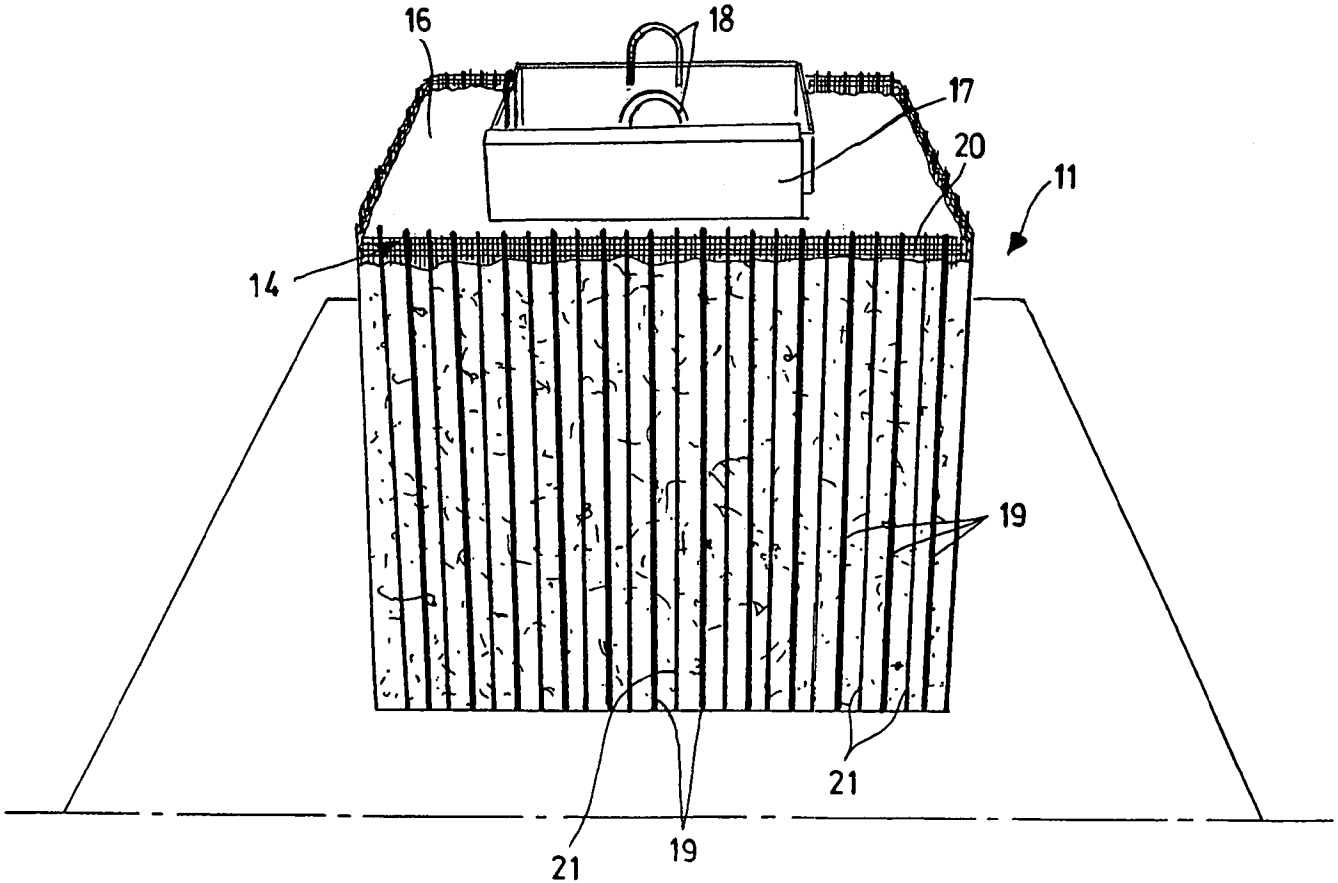
FIG. 2 shows a further perspective partial view of an example of disposable structure wherein the concrete has been cast and a central socket-shaped element must be extracted which makes a seat for a pillar.

With reference to FIGS. 1 and 2, there is shown hot it is possible to use a disposable structure for making foundations, plinths and construction elements in general, according to the present invention.

In fact, FIG. 1 shows a perspective partial view of a disposable structure for making a plinth before the concrete is cast, globally indicated with reference numeral 11.

This structure 11 comprises a series of reinforcing rods 12, 13, variously bent and crossed, for forming a reinforcing cage, for example belonging to a base of a plinth (not shown and in se known).

The reinforcing rods 12, 13 are surrounded and enclosed by at least one containment element, globally indicated with reference numeral 14, which is tied or crimped to rods 12, 13.

FIG. 2 shows how, once the concrete has been cast into the base of plinth 11, on jutting rods (not shown) protruding therefrom, a containment element 14, similar to the previous one, is further arranged, connected in the same way to the rods. FIG. 2 even shows the subsequent step wherein concrete 16 has been cast into the structure thus realised.

On top, end portions of the jutting rods of pillars (not shown) protrude, at the centre of which there is arranged a socket for pillars 17, provided with handles 18, for the extraction thereof, once the casting has settled.

Figure 3:
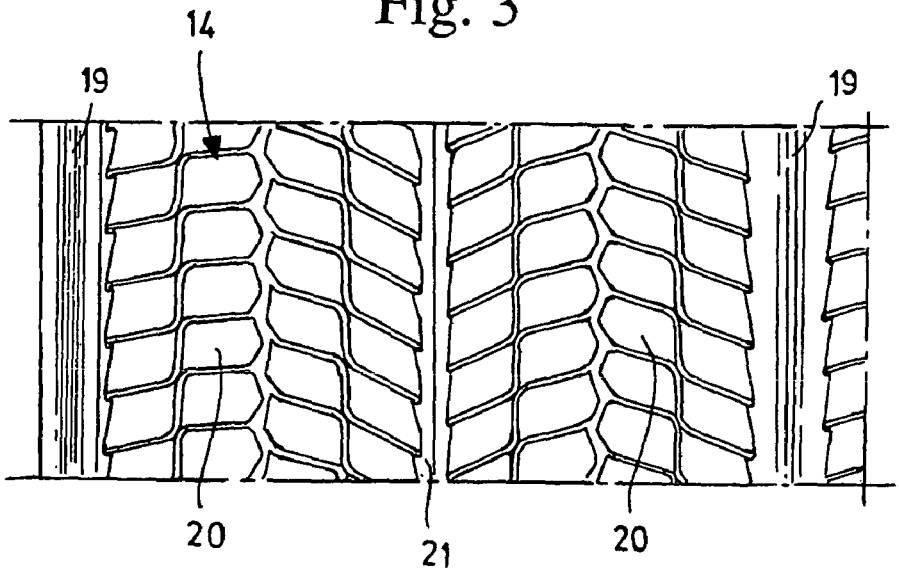
FIG. 3 shows an enlarged front partial view of a disposable structure as used in the examples of FIGS. 1 and 2.
Figure 4:
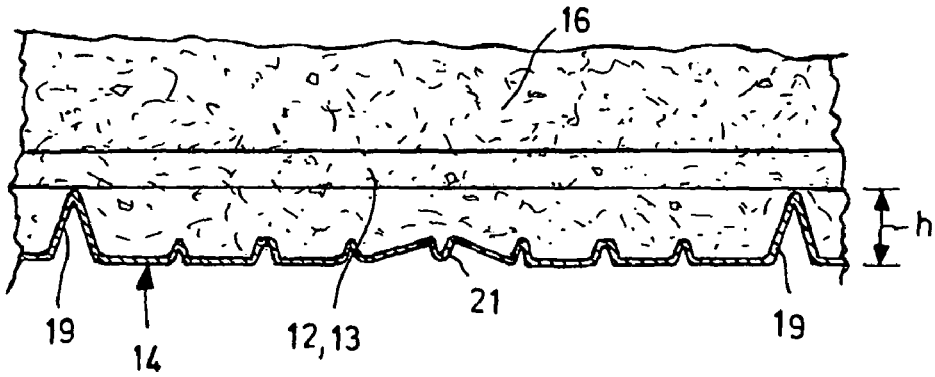
FIG. 4 shows an enlarged partial section of the structure of FIG. 3 when applied in a casting like that shown in FIGS. 1 and 2.

According to the present invention, the containment element 14, better shown in FIGS. 3 and 4, is obtained by a metal sheet treated with a special machine and transformed into a continued product.

The containment element 14 exhibits a series of main V-shaped ribs 19, interspaced from one another and connected by a mesh construction 20, which realises a beehive structure. In this mesh construction 20 there are provided further secondary ribs 21, also shaped as a V, in a central zone of the construction for determining minimum stiffening to the structure, while allowing bending thereof without much trouble and good adaptability to the forms being made.

Both the main V-shaped ribs 19 and the secondary ribs 21, also shaped as a V, have a pattern longitudinal to the containment element 14.

The main V-shaped ribs 19 are facing the reinforcing rods and have a height h between 1.5 and 3.0 cm so as to space the containment element 14 from the iron cages to a sufficient extent. In this way, certain conformity of the structure to the regulations relating to the placing of iron in reinforced concrete structures is obtained.

FIGS. 1 and 2 show how the containment element 14 of the rods, once the concrete has been cast, remains almost superficially incorporated into the plinth or into the generic foundation and requires no difficult form dismantling actions, with disengagement of pickets, props and anything else was usually supporting the formwork portions.

The configuration of the containment element 14 with a mesh construction 20 with a beehive structure allows perfect incorporation in the concrete with outer surface almost finished and ready for the following applications. In fact, it must be noted that the presence of the main V-shaped ribs 19 and of the secondary V-shaped ribs 21, interspaced from one another and connected, ensures certain sturdiness and linearity of the product thus obtained. Moreover, it is repeated that the main V-shaped ribs 19 are arranged with the tip thereof facing the reinforcing rod, whereas the secondary V-shaped ribs 21 are arranged with the tip thereof facing outwards the casting or the construction element.

The absence of any handling of external support reinforcements, such as boards or the like, considerably reduces the costs for manufacturing the cast structures.

Moreover, another very important advantage determined by the present invention must be underlined.

As can be seen in FIG. 1 and partly in FIG. 2, the containment element 14 with a mesh construction 20 with beehive structure and main V-shaped ribs 19 and secondary V-shaped ribs 21, interspaced from each other and connected, allows making the reinforcement and the formwork directly at the factory, ready to be then transported and installed on site.

This is a great advantage from the operating and technological point of view as compared to all the existing and known formwork structures.

In fact, once the type of building element to be made is known, once the dimensions and the arrangements of the reinforcing rods as well as the final overall dimensions of the building element have been received, it is possible to make both the inner reinforcement and the placing of the containment element 14 at the factory, ready for the casting.

Such composite structure is then transported to the site of use, already assembled, to be placed in the desired position and to receive the concrete, without needing any alignment between rods, containment structures, further fixing elements, if required.

Several changes and variations can be made to a disposable structure for making foundations, plinths and construction elements in general thus conceived, all falling within the present invention; moreover, all details can be replaced with technically equivalent elements. In the practice, the materials used as well as the sizes, can be whatever, according to the technical requirements.

The invention claimed is:

1. A disposable structure for making foundations, plinths and construction elements in general wherein there is provided an iron reinforcement (12, 13) arranged in at least one containment element (14) for receiving concrete (16), characterised in that said at least one containment element (14) comprises a metal sheet exhibiting a series of main V-shaped ribs (19), interspaced from one another and connected by a mesh construction (20), which realises a beehive structure, and by further secondary ribs (21), also shaped as a V, in a central zone of the mesh construction, said series of main V-shaped ribs (19) being arranged against said iron reinforcement (12, 13) and having a height (h) between 1.5 and 3.0 cm.

2. A structure according to claim 1, characterised in that both the main V-shaped ribs (19) and the secondary V-shaped ribs (21) have a pattern longitudinal to the containment element (14).

3. A structure according to claim 1, characterised in that it can be made at the factory and, once finished, be placed into the building yard.

4. A structure according to claim 1, characterised in that the main V-shaped ribs (19) are arranged with the tip thereof facing the iron reinforcement (12, 13) whereas the secondary V-shaped ribs (21) are arranged with the tip thereof facing outwards the construction element.

* * * * *